US006300582B1

(12) United States Patent
Huang

(10) Patent No.: US 6,300,582 B1
(45) Date of Patent: Oct. 9, 2001

(54) DUSTPROOF AND DROPLET-PROOF KEYSWITCH

(75) Inventor: Gear Huang, Taipei (TW)

(73) Assignee: Silitek Corporation, Taipei (TW)

( * ) Notice: Subject to any disclaimer, the term of this patent is extended or adjusted under 35 U.S.C. 154(b) by 0 days.

(21) Appl. No.: 09/501,987

(22) Filed: Feb. 11, 2000

(51) Int. Cl.[7] ..... H01H 13/02; H01H 3/12; H01H 13/705

(52) U.S. Cl. ..... 200/302.2; 200/341; 200/345; 200/517

(58) Field of Search ..... 200/5 A, 341–345, 200/512–517, 302.1–302.3

(56) References Cited

U.S. PATENT DOCUMENTS 5,386,091 * 1/1995 Clancy ..... 200/517
5,396,038 * 3/1995 Yamada ..... 200/517
5,430,267 * 7/1995 Ozeki et al. ..... 200/302.2
5,438,177 * 8/1995 Fagan ..... 200/517
5,493,087 * 2/1996 Yoshida et al. ..... 200/302.2
5,525,979 * 6/1996 Engle et al. ..... 200/512
5,684,279 * 11/1997 Burgett ..... 200/5 A
5,718,327 * 2/1998 Wu ..... 200/344

* cited by examiner

*Primary Examiner*—J. R. Scott
(74) *Attorney, Agent, or Firm*—Rosenberg, Klein & Lee

(57) ABSTRACT

A dustproof and droplet-proof keyswitch is provided. The keyswitch includes a base plate with at least one stage formed thereon, each stage having a step portion formed at a top part; an elastic member arranged on the step portion; a key cap mounted on the elastic member and having a plunger inserting into the stage. The plunger has an elastic plate clamped between a pair of grooves and having a hook on a lower end thereof; the hook having a beveled lower end latched with the stage when the key cap is released. The stage has at least one projecting rib on an inner side thereof corresponding to at least one notch on the plunger to provide a clamping effect. Therefore, the keyswitch can be used under severe conditions such as in a dusty environment or when the keyboard has spilled on it a liquid such as tea or coffee.

12 Claims, 8 Drawing Sheets

DUSTPROOF AND DROPLET-PROOF KEYSWITCH

FIELD OF THE INVENTION

The present invention relates to a dustproof and droplet-proof keyswitch for use in a hazardous environment with dust and droplets, which also is of lower cost and easy assembly.

BACKGROUND OF THE INVENTION

With reference to FIGS. 6 to 8, a conventional keyswitch comprises at least a key cap 6 and a hollow plunger 7 connected with the key cap 6. The key top 61 of the key cap 6 has a cross-shaped pole 62 extending from its bottom surface that engages two pairs of ribs 71 within the hollow plunger 7. The cross-shaped pole 62 should be tightly fit with the pairs of ribs 71 to facilitate the key pressing operation. However, the key cap 6 is made with a predetermined rigid material, and the hollow plunger 7 must be made with flexible material to allow tight fitting with the key cap 6. Material and manufacture costs are thereby increased. Moreover, the top portion of the plunger 7 is liable to crack when being assembled with the rigid key cap 6.

The plunger 7 has two bevels 72 formed on both sides thereof. The bevels 72 engage two lengthwise slits 83 formed in the inner sleeve 82 housed by an outer sleeve 81 of a plunger stage 8. The plunger 7 has two annular shaped portions 73 formed thereon to receive the bottoms of outer and inner sleeves 81 and 82 such that the space within the outer sleeve 81 is sealed. This kind of keyboard keyswitch is employed in cash registers and is formed with a bump 74 on the bottom of the plunger 7 to contact a switch sheet. However, this keyboard is of a two-piece design, and the structure thereof is complicated. Moreover, an elastic ring 9 is arranged on a step portion 84 on top of the outer sleeve 81 to provide restoring force and prevent the entry of dust and droplets. However, the structure is not satisfactory and requires improvement.

It is the object of the present invention to provide a dustproof and droplet-proof keyswitch wherein a key cap and a plunger are inserted into a stage on a base plate, and an elastic member between the stage and the key cap provides a seal for the keyswitch against dust and droplet entry. Therefore, the keyswitch can be used under severe conditions such as in a dusty environment or when the keyboard has spilled upon it a liquid such as tea or coffee.

To achieve the above objects, a dustproof and droplet-proof keyswitch comprises a base plate with at least one stage formed thereon, each having a step portion on top of the stage; an elastic member arranged on the step portion; a key cap mounted on the elastic member and having a plunger inserting into the stage. The plunger has an elastic plate clamped between a pair of grooves and having a hook on a lower end thereof; the hook having a beveled lower end thereof latched with the stage when the key cap is released. The stage has at least one projecting rib on an inner side thereof corresponding to at least one notch on the plunger to provide a clamping effect.

BRIEF DESCRIPTION OF THE DRAWINGS

The various objects and advantages of the present invention will be more readily understood from the following detailed description when read in conjunction with the appended Drawings, in which.

DETAILED DESCRIPTION OF THE PREFERRED EMBODIMENTS

Figure 1A:
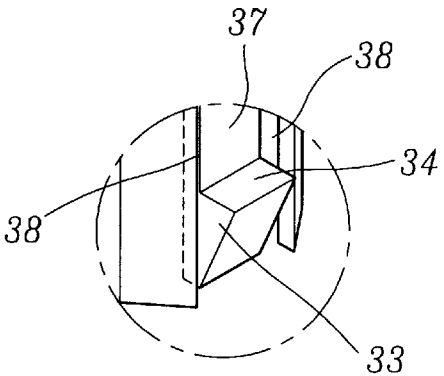
FIG. 1A is an enlarged view of the part a in FIG. 1.
Figure 1:
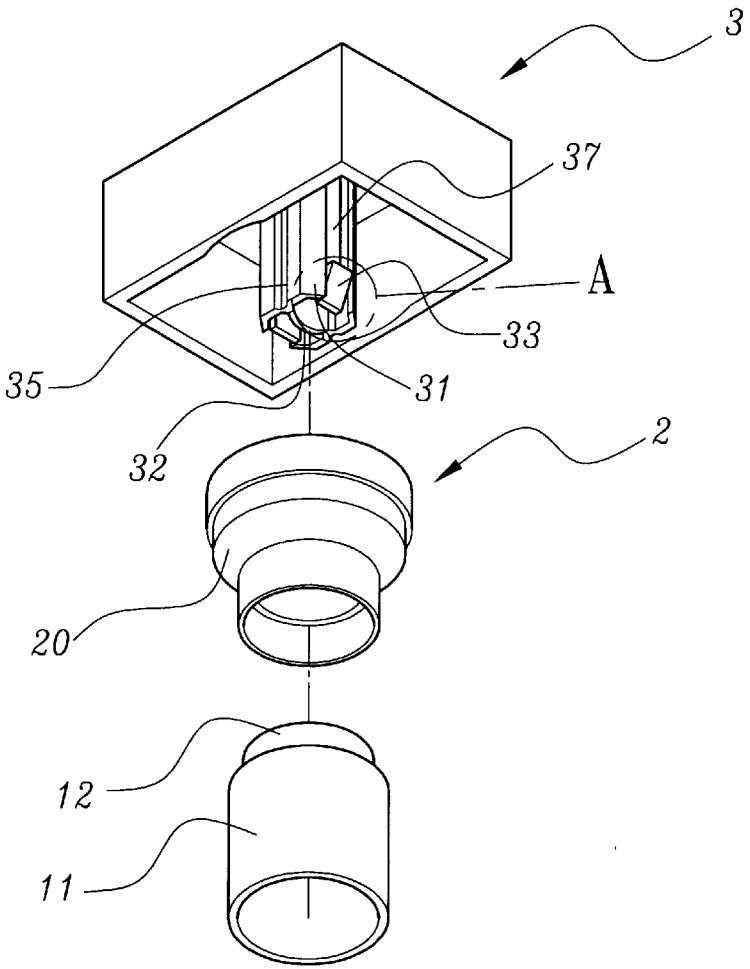
FIG. 1 is an exploded view of the inventive keyswitch.
Figure 2:
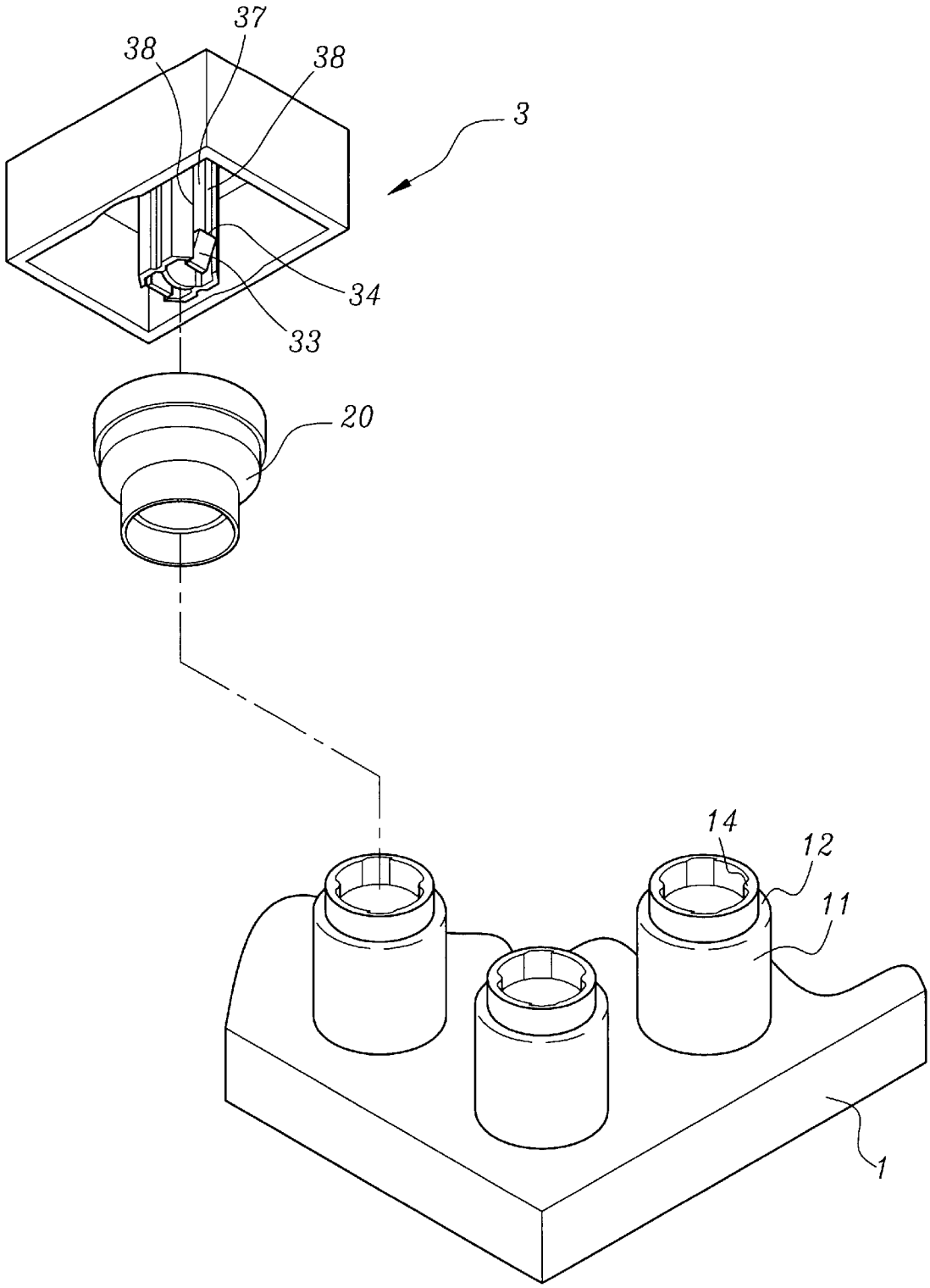
FIG. 2 is an exploded view of a base plate shown with the inventive keyswitch.

With reference now to FIGS. 1 to 4, the present invention is intended to provide a dustproof and droplet-proof keyswitch. The inventive keyboard comprises at least one base plate 1, a plurality of stages 11 formed on the plate 1 and each having a step portion 12, and an elastic member to arrange on the step portion 12. The elastic member 2, for example, can be an elastic tube 20 or a spring (not shown), or other functionally equivalent assembly of an elastic member and spring to keep out dust and liquid droplets. The elastic tube 20 abuts the step portion 12 at a lower end thereof and abuts the bottom of the key cap 3 at an upper end thereof.

Figure 3:
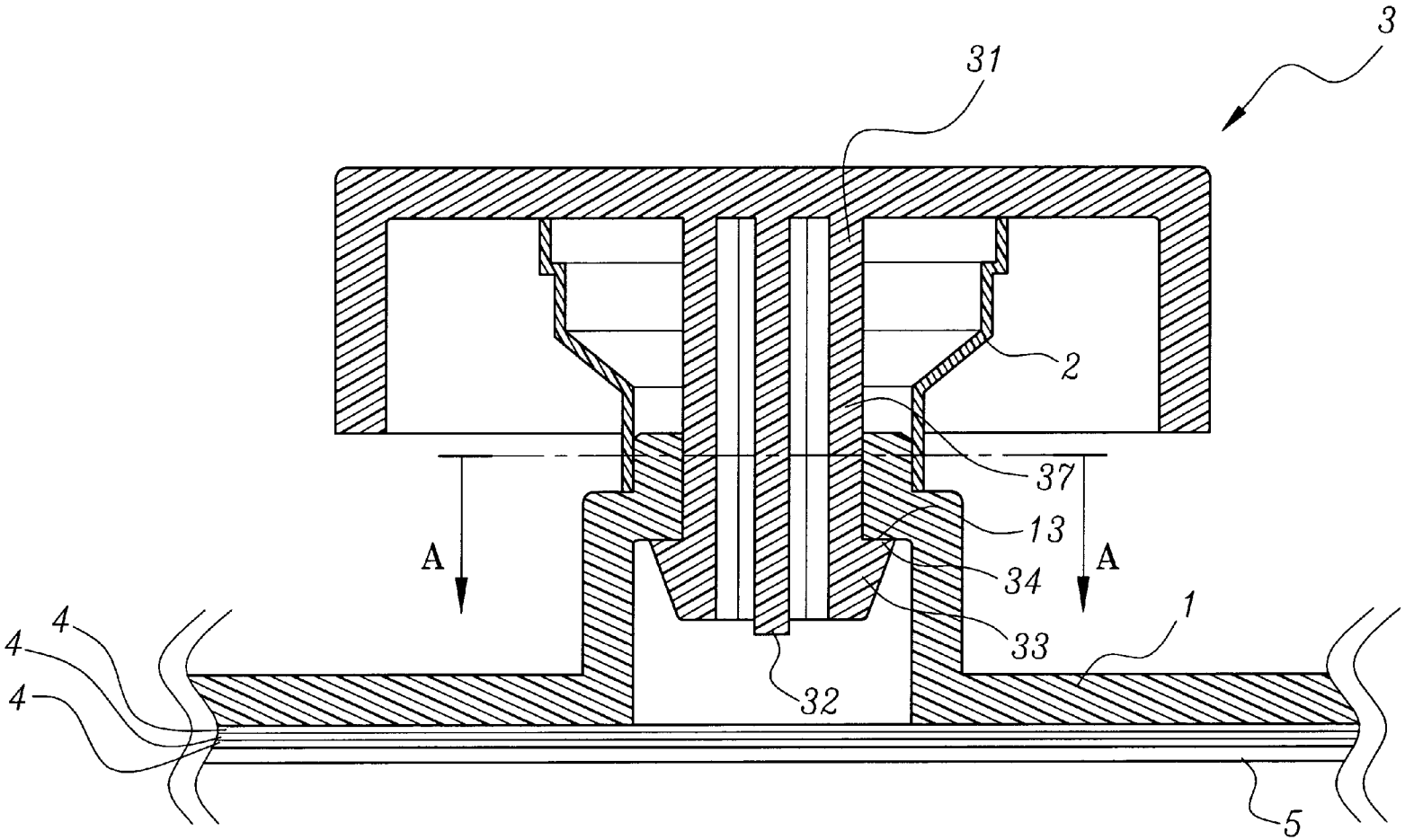
FIG. 3 is a sectional view of the assembled keyswitch.
Figure 4:
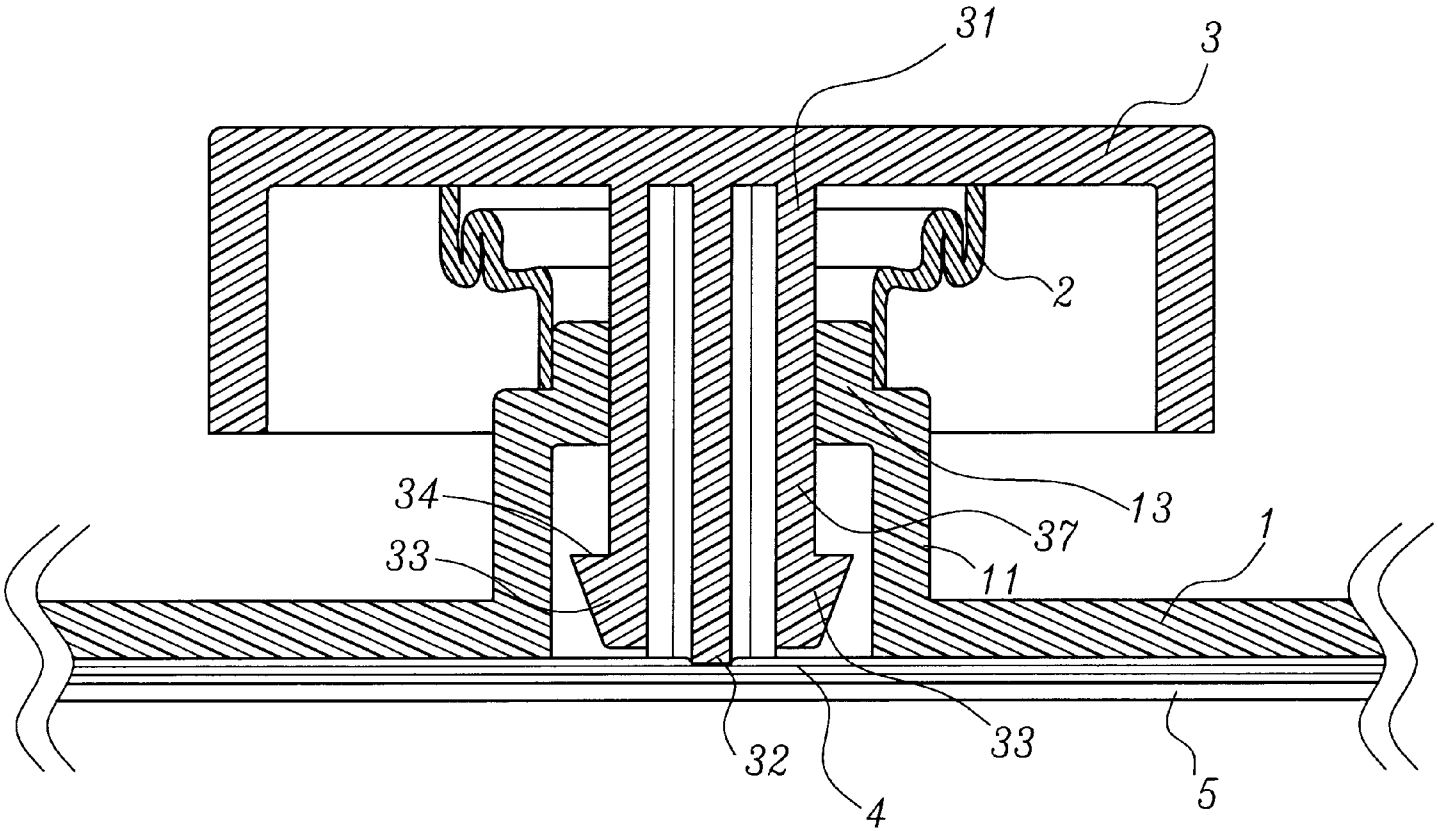
FIG. 4 shows the operation of the keyswitch shown in FIG. 3.

A key cap 3 has a plunger 31 extended from a center bottom portion thereof. The plunger 31 has a center flange 32 on the center bottom portion thereof for contacting a switch circuit board 4. The plunger 31 inserts into the stage 11. The plunger 31 has two elastic plates 37 each clamped between a pair of grooves 38 and having a hook 33 on a lower end thereof. A bevel 34 of the hook 33 is locked to an annular flange 13 on the step portion 12. The stage 11 has two bumps 14 beside the two elastic plates 37 which engage two notches 35 formed along the plunger 31. Therefore, the key cap 3 is assembled on the base 1 by locking the hook 33 of the plunger 31 within the step portion 12 at an inner side of the stage 11. Only the bottom portion of the flange 32 extends out of the stage 11 to contact the switch circuit board 4 (generally a three-layer switch circuit board). The switch circuit board 4 is mounted on a support plate 5. As shown in FIGS. 3 and 4, the peripheral portion of the plunger 31 does not outstep the bottom of the stage 11 when the key cap 3 is pressed.

Figure 5:
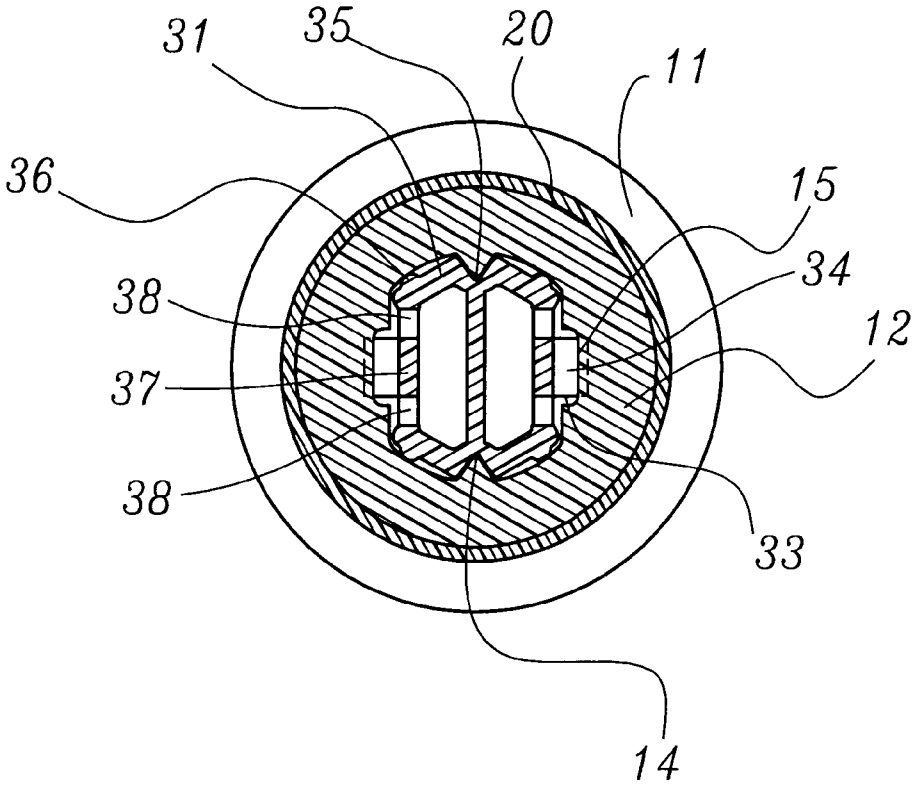
FIG. 5 is a sectional view along Line A—A of FIG. 3.
Figure 6:
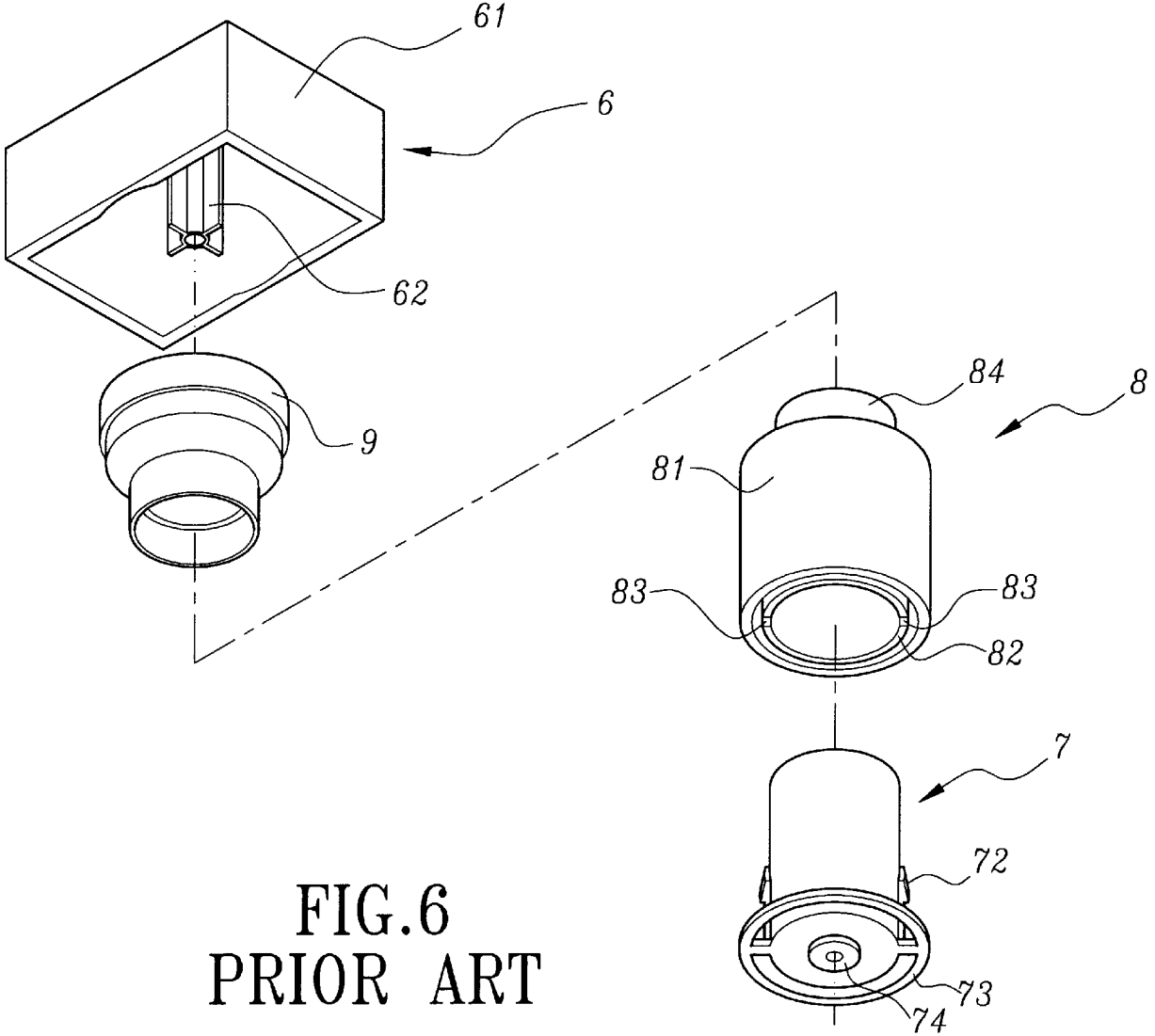
FIG. 6 PRIOR ART
FIG. 6 is an exploded view of a prior art keyswitch.
Figure 7:
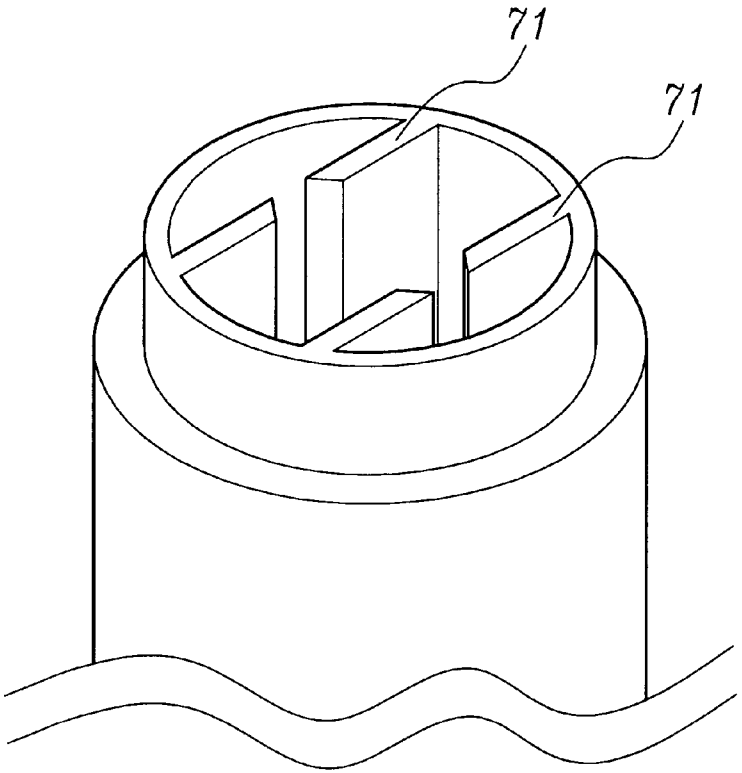
FIG. 7 PRIOR ART
FIG. 7 is a perspective view of a prior art keyswitch.
Figure 8:
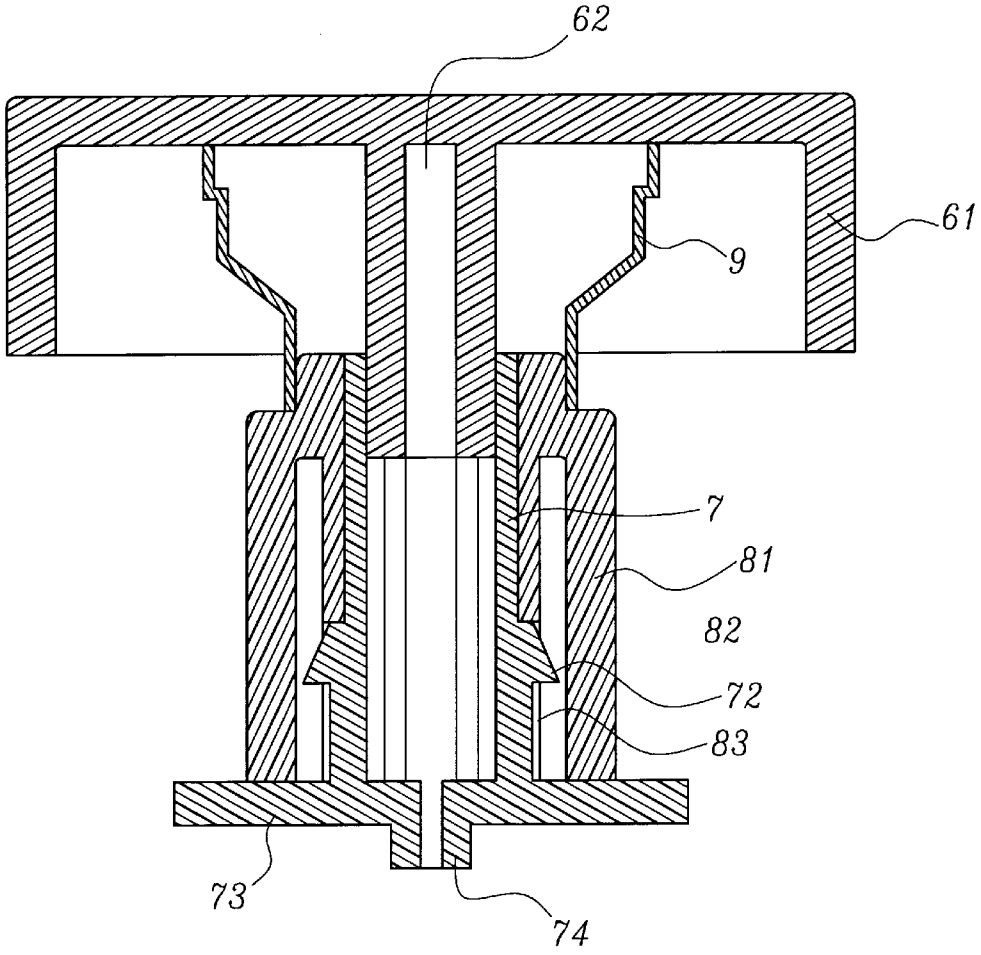
FIG.8 PRIOR ART
FIG. 8 is a sectional view of a prior art keyswitch.

As shown in FIG. 5, the plunger 31 has a nearly rectangular sectional contour, maintaining a parallelogram shape after being inserted into the stage 11. The plunger 31 has notches 35 formed along opposed surfaces thereof. On both sides of the notches 35 are formed strips 36 for engaging the inner side of the stage 11. A pair of opposed sides of the plunger 31 are substantially planar and are formed with two elastic plates 37 with hooks 33. The hooks 33 are latched with the corresponding clamping grooves 15 in the inner surface of the stage 11. More particularly, the stage 11 provides a directive clamping effect via a pair of clamping grooves 15 and a pair of projecting ribs 14. Therefore, the shaking and friction of the key during a pressing operation are reduced.

As described above, the present invention utilizes an integrally formed key cap, a stage, and an elastic tube to restore the key cap in position while sealing the space between the stage and plunger. Therefore, dust and liquid droplets can be prevented from being sucked into the keyswitch.

The hooks are provided to prevent the decoupling of the key cap when subjected to ordinary decoupling forces. The plunger has a nearly rectangular sectional contour that correspondingly engages the ribs and clamping grooves formed on the inner side of the stage to prevent shaking and friction during a key pressing operation. The above described is a keyswitch with symmetric structure. It should be known that the present invention can be implemented with at least one hook and at least one notch on both sides of the plunger to fit with the strip. Moreover, the present invention can be implemented with two hooks on two lateral sides and two notches on two other lateral sides. The keyswitch can be used under severe conditions such as in a dusty environment or when a liquid such as tea or coffee is spilled upon it.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A dust and liquid resistant keyswitch assembly disposed upon a circuit board comprising:

(a) a base plate including at least one stage support member, said stage support member having a substantially tubular lower portion and a substantially tubular upper portion extending axially therefrom, said lower and upper portions being joined by a step portion extending radially therebetween, said lower and upper portions each defining respective inner surfaces;

(b) a key cap displaceably coupled to said stage support member, said key cap including a top portion and a plunger portion projecting longitudinally therefrom, said plunger portion extending coaxially through and slidably engaging said inner surface of said stage support member upper portion to be displaceable between released and pressed positions, said plunger portion in said released position retentively engaging said step portion of said stage support member and in said pressed position extending axially through said lower portion of said stage support member for contacting the circuit board; and (c) an elastic member elastically disposed between said top portion of said key cap and said step portion of said stage support member to encircle at least a portion of said key cap plunger portion.

2. The dust and liquid resistant keyswitch assembly as recited in claim 1 wherein said plunger portion has formed at a terminal end thereof a protruding flange for engaging the circuit board when said plunger portion is disposed in said pressed position.

3. The dust and liquid resistant keyswitch assembly as recited in claim 1 wherein said plunger portion has defined thereon a lateral side section, said lateral side section including at least one hook protruding laterally outward therefrom for engaging said step portion of said stage support member.

4. The dust and liquid resistant keyswitch assembly as recited in claim 3 wherein said lateral side section includes a longitudinally extended elastic plate having a terminal end defined by said hook, said hook having a bevelled part abutting said step portion of said stage support member when said plunger portion is disposed in said released position.

5. The dust and liquid resistant keyswitch assembly as recited in claim 3 wherein said step portion of said stage support member defines an annular flange, said hook of said plunger portion retentively engaging said annular flange when said plunger portion is disposed in said released position.

6. The dust and liquid resistant keyswitch assembly as recited in claim 3 wherein said upper portion of said stage support member has formed in said inner surface thereof at least one longitudinally extended clamping groove for the slidable passage of said hook therethrough.

7. The dust and liquid resistant keyswitch assembly as recited in claim 1 wherein said elastic member has a substantially tubular configuration.

8. The dust and liquid resistant keyswitch assembly as recited in claim 1 wherein said elastic member includes at least a pair of axially offset sections joined by a tapered intermediate section.

9. The dust and liquid resistant keyswitch assembly as recited in claim 7 wherein said elastic member is formed of a rubber material.

10. The dust and liquid resistant keyswitch assembly as recited in claim 1 wherein said plunger portion of said key cap has formed therein at least one longitudinally extended notch.

11. The dust and liquid resistant keyswitch assembly as recited in claim 10 wherein said upper portion of said stage support member includes at least one longitudinally extended rib protruding radially inward from said inner surface thereof, said rib engaging said notch of said plunger portion.

12. The dust and liquid resistant keyswitch assembly as recited in claim 10 wherein said plunger portion of said key cap has formed therein at least a pair of longitudinally extended strips protruding laterally outward therefrom, said strips having being disposed on opposite sides of said notch.

* * * * *